US006546566B1

(12) United States Patent
Geisel

(10) Patent No.: US 6,546,566 B1
(45) Date of Patent: Apr. 15, 2003

(54) WATER CONSERVING URINATION SYSTEM

(76) Inventor: Anthony Geisel, 2291 Longacres La., Palatine, IL (US) 60067-7752

( * ) Notice: Subject to any disclaimer, the term of this patent is extended or adjusted under 35 U.S.C. 154(b) by 0 days.

(21) Appl. No.: 09/942,094

(22) Filed: Aug. 29, 2001

(51) Int. Cl.[7] ..... A47K 11/12
(52) U.S. Cl. ..... 4/144.1; 4/340
(58) Field of Search ..... 4/144.1, 144.3, 4/144.4, 301, 340, 341, 342

(56) References Cited

U.S. PATENT DOCUMENTS

| | | | | | |
|---|---|---|---|---|---|
| 105,979 | A | * | 8/1870 | Price | 4/144.1 |
| 4,020,843 | A | * | 5/1977 | Kanall | 4/144.3 X |
| 4,145,768 | A | | 3/1979 | Chevrette | 4/144.1 |
| 4,282,611 | A | | 8/1981 | O'Day | 4/144.1 |
| 4,320,756 | A | | 3/1982 | Holmes | 128/206.12 |
| 4,359,786 | A | * | 11/1982 | Rosberg et al. | 4/144.1 |
| 4,450,595 | A | | 5/1984 | Saccomanno | 4/301 |
| 4,985,940 | A | * | 1/1991 | Jones | 4/301 |
| D319,304 | S | | 8/1991 | Johnson | D23/309 |
| 5,301,374 | A | * | 4/1994 | Smiley | 4/341 |
| 5,390,374 | A | | 2/1995 | Hubrig et al. | 4/301 |
| 5,737,779 | A | * | 4/1998 | Haddock | 4/301 |
| 6,021,531 | A | * | 2/2000 | Kirko | 4/144.3 |

* cited by examiner

*Primary Examiner*—Robert M. Fetsuga
(74) *Attorney, Agent, or Firm*—Holland & Knight LLP

(57) ABSTRACT

Disclosed is a unisex urination system. The portable system permits a user to direct a stream of urine over the trap of a toilet and into a sewer line. This results in substantial water savings and aids in keeping the toilet in a sanitary condition. The system includes a funnel and hose, each covered in a hydrophobic material to prevent the collection of water born germs and bacteria. The system also includes a stand for the funnel and hose that facilitate storage when the device is not in use.

5 Claims, 3 Drawing Sheets

WATER CONSERVING URINATION SYSTEM

BACKGROUND OF THE INVENTION

1. Field of the Invention

This invention relates to urinal system. More particularly, the present invention relates to a urinal system that prevents droplets of water and or urine from hitting the rim of the toilet and the floor surrounding the toilet, and that eliminates the need of flushing a conventional toilet, thereby saving water.

2. Description of the Background Art

Water conservation is gaining increased importance in our society. Many areas in the country are suffering the effects of long term drought, in these areas water conservation is a matter of necessity. Other areas seek to conserve as a way to reduce the costs and time needed to treat water and make it potable. In either event, all aspects of our daily lives are being examined to determine if water is being wasted. The bathroom is one area where water is often needlessly used.

Congress recently highlighted the importance of water conservation by enacting the Federal Energy Conservation Act, 42 U.S.C. Section 6295. This federal act regulates the amount of water toilets can use. Specifically, gravity tank-type toilets, flushometer tank toilets and electromechanical hydraulic toilets are now limited to 1.6 gallons per flush. Older toilet constructions typically use between 3.5 to 5.0 gallons per flush. This federal legislation implicates toilets as potentially one of the biggest water wasters in today's household. However, the Energy Conservation Act only applies to toilets constructed after Jan. 1, 1994. Consequently, many older water wasting toilet constructions are still in existence. Thus, there exists a need to enable these older toilets to save water without their replacement.

One such system is disclosed in U.S. Pat. No. Des. 319,304 to Johnson. Johnson discloses a water conserving toilet receptacle. Yet another example is embodied in U.S. Pat. No. 5,390,374 to Hubrig et al. Hubrig discloses a water-conserving urinal which is attachable to a toilet. The urinal allows fluid waste to be discharged directly to a sewer line without the necessity of a full flush of the toilet, thereby saving water. Likewise, U.S. Pat. 4,450,595 to Saccomanno discloses a water saving liquid waste disposal system for use with a water closet. The system allows fluid to be directly routed to a sewer line. Again, this helps reduce water usage.

Although each of the above referenced inventions achieves its individual objective, they all suffer from a common problems. For example, all of the above referenced inventions are, in some way, fixed to a toilet or flush closet. Consequently, the above referenced urinals are disposed within the toilet or flush closet for extended periods of time, allowing for the accumulation of germs and bacteria. In other words, none of the above referenced inventions are portable. This lack of portability means that many different devices would need to be purchased for the typically household.

SUMMARY OF THE INVENTION

It is therefore one of the objectives of this invention to provide a water conserving urinal that is portable and which can be removed from a toilet after use, thereby promoting sanitary conditions.

It is also an object of this invention to enable a user to use a toilet without the need for flushing the toilet, thereby saving water, and also it prevents droplets of water and or urine from hitting the rim of the toilet and the floor surrounding the toilet.

Still another object of this invention to make a water conserving urinal that is water resistant such that germs and bacteria will not adhere to its surface when placed in a toilet.

Another object of this invention is to provide a portable means to deliver a small quantity of water to a urinal when needed to facilitate flushing.

These and other objectives are accomplished by providing a water conserving urination system. The system includes a toilet having a bowl containing a volume of fluid adapted to be periodically disposed by way of flushing, and a trap at a lower end of the bowl in communication with a sewer line. The system also includes a urinary aid having a funnel portion and a hose portion. The funnel portion, in turn, has an interior portion and a squared cross section, an opened upper end and a tapering lower end that is integral and in fluid communication with the hose. The funnel portion is adapted to receive urine from a user. To facilitate handling by a user, a handle is integrally formed at the upper end of the funnel. The handle allows a user to grasp the aid.

With the aid properly oriented, the hose is positioned within the bowl with its distal end disposed over the trap and in direct fluid communication with the sewer line. To promote sanitary conditions, the entire aid is covered with a hydrophobic material. A mesh screen is positioned within the funnel and functions to prevent foreign objects from entering the hose.

The aid also includes a lid. The lid has an integral lip formed about its periphery, with the lip creating a cup adapted to hold a volume of fluid. The lip is dimensioned to form a friction fit with the opening of the funnel, the lid further includes a handle to assist in removing the lid from the funnel. When removed from the funnel, the cup can be filled with water and the water can thereafter be poured into the funnel for the purpose of flushing urine over the trap. Finally, the system includes a stand for use in supporting the aid when it is not in use. The stand has a lower bulbous portion for receiving the hose, and upper cone shaped opening for receipt of the funnel and a narrow intermediate extent.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

The present invention relates to a unisex urination system. The portable system permits a user to direct a stream of urine over the trap of a toilet and into a sewer line. This results in substantial water savings. The system includes a funnel and hose, each covered in a hydrophobic material to reduce the chance of collection of water born germs and bacteria. The system also includes a stand for the funnel and hose that facilitates storage when the device is not in use.

Figure 1:
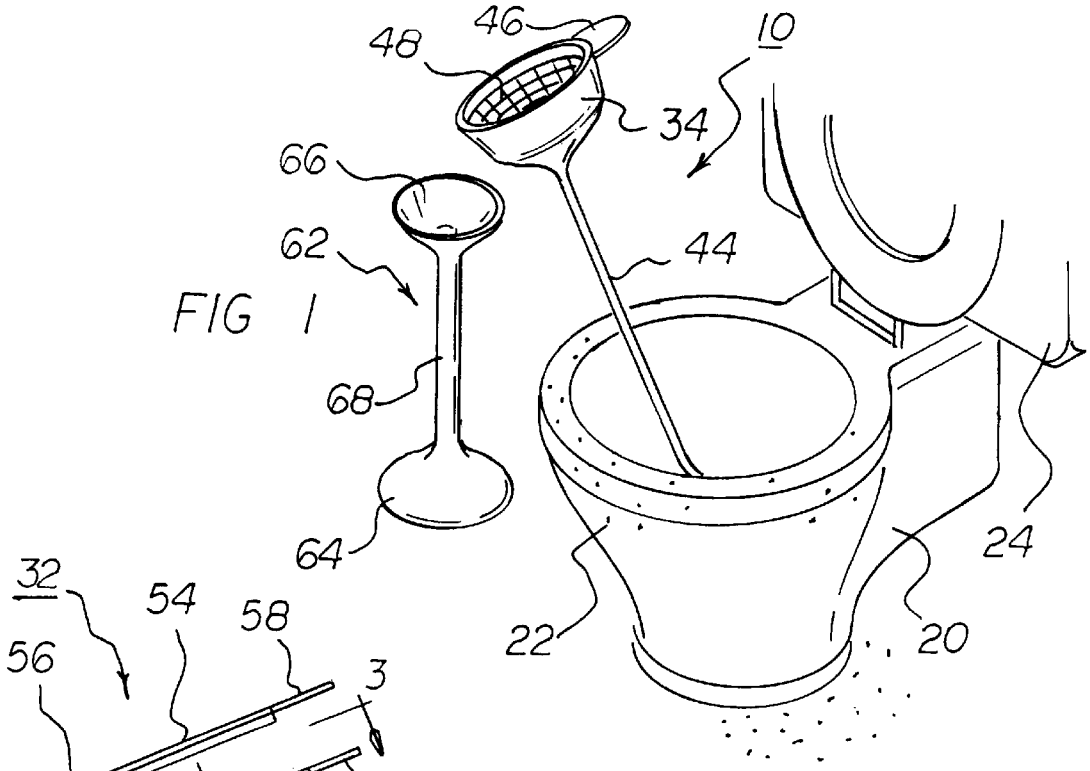
FIG. 1 is a perspective view of the urinal system of the present invention.
Figure 2:
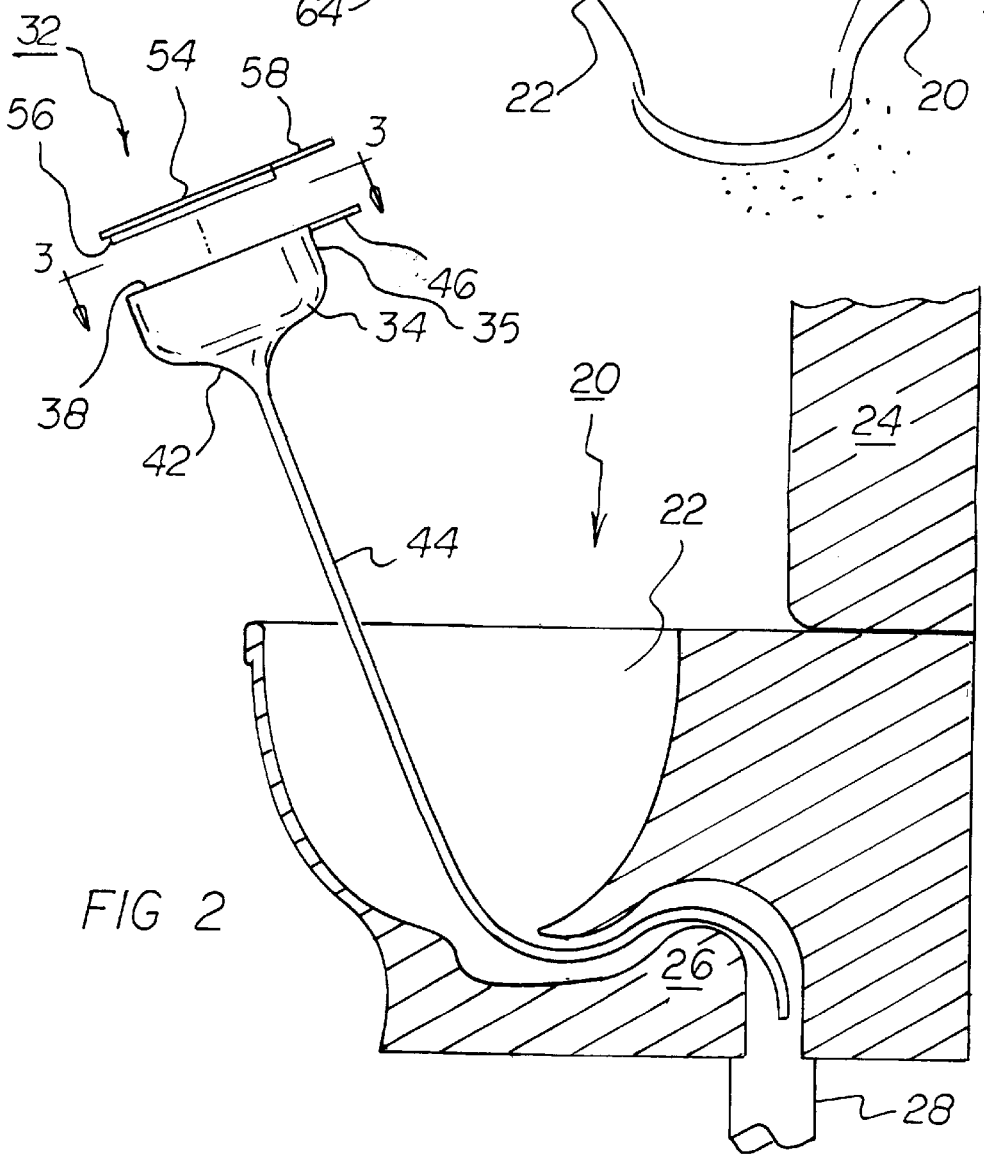
FIG. 2 is a partial sectional view of FIG. 1.

With reference to FIG. 1, the water conserving urination system 10 of the present invention is depicted. As illustrated, the system includes a conventional flush toilet 20 or water closet. As is typical in most toilets, a water filled bowl 22 is employed to receive human waste. This water is periodically disposed by flushing. Flushing is accomplished by permitting water stored within an adjacent closet 24 to flow into the bowl 22. This causes water within the bowl 22 to rise to a level higher than an adjacent trap 26, thereby permitting the water and waste to exit the toilet 20. As illustrated in FIG. 2, the trap 26, which is in communication with a sewer line 28, is created by a bend in the pipe at the lower end of the bowl 22. Flushed water exits the toilet bowl 22 over the trap 26 and is dispensed into the sewer line 28.

With continuing reference to FIG. 1, the urinary aid device 32 is disclosed. The device includes funnel and hose portions (34 and 44, respectively). In the preferred embodiment, the funnel portion 34 is defined by an elongated squared cross section. This cross section lends itself to either male or female use. The funnel 34 further includes an opened upper end 35 and interior portion for receipt of a volume of urine. Both FIGS. 1 and 2 illustrate the tapering lower end 42 of the funnel 34 that is fluid communication with, and integral to, the hose 44. As indicated, the funnel portion 34 is adapted to receive urine from either a male or female user. As such, the device 32 can be used in either a standing or squatting orientation. In this regard, a handle 46 is integrally formed at the upper end of the funnel 34 that assists user in grasping the device 32. As indicated, use of funnel 34 prevents droplets of water and or urine from hitting the rim of the toilet and the floor surrounding the toilet. FIG. 1 illustrates these droplets which may otherwise occur absent use of the present invention.

With reference now to FIG. 2, the hose 44 the device 32 is depicted. As illustrated, the hose 44 is preferably positioned within the bowl 22 such that its distal end is disposed over the trap 26. As such, a continuous fluid line is created from the funnel 34, through the hose 44, and into the sewer line 28. Thus, urine directed into the funnel 34 is routed directed into the sewer line 28. No flushing is necessary. This results in substantial water savings.

In a important aspect of the present invention, the entire device 32 is portable and can be removed from the toilet 20 in which it is used. In other words, the device 32 is only inserted within a toilet 20 when a user wishes to urinate. In this regard, the device 32, although adapted to be positioned within a toilet 20, is not permanently or securely connected to the toilet 20. The enables users to easily insert and remove the device from a toilet 20, which promotes the use of the inventive system.

In order to avoid the unsanitary conditions that would otherwise result from use of such a portable system, the funnel 34 and hose 44 are covered with a hydrophobic material. Preferred hydrophobic materials include polypropeline, teflon or polysilicon. Other hydrophobic materials are within the scope of the present invention, the essential characteristic being that the selected material repels water. The hydrophobic coating precludes water born germs and bacteria from collecting upon the funnel or hose portions when they are in contact with the toilet water.

Figure 3:
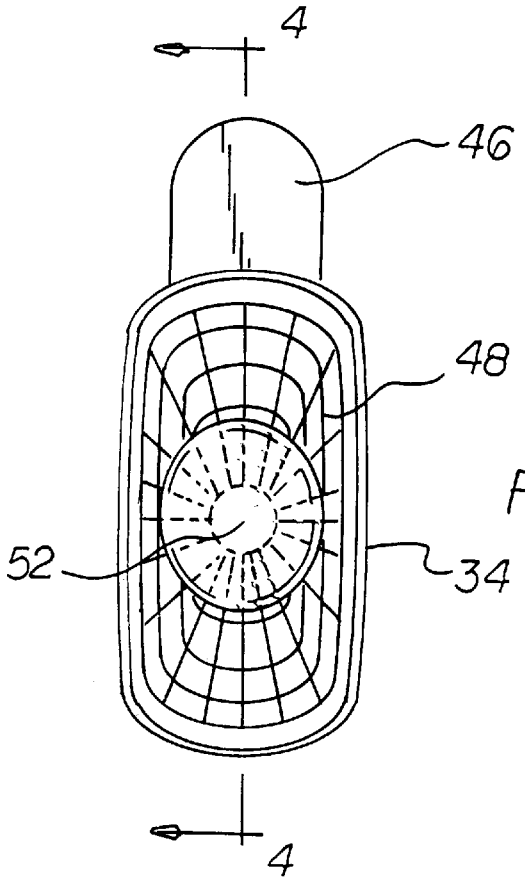
FIG. 3 is a view of the funnel taken along line 3—3 of FIG. 2.
Figure 4:
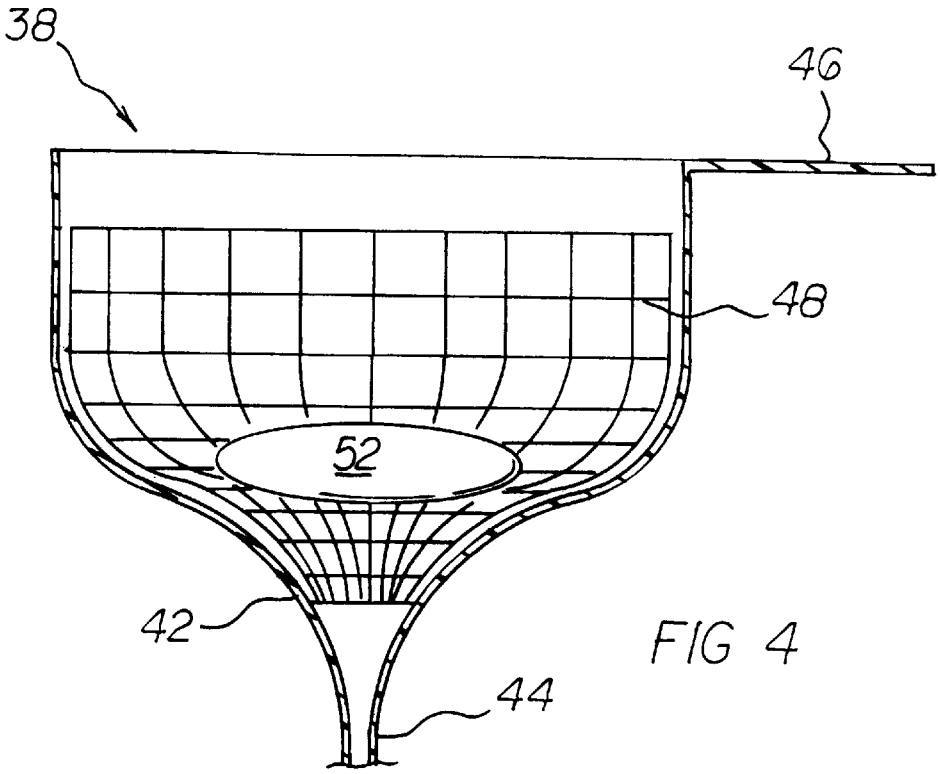
FIG. 4 is a sectional view of the funnel taken along line 4—4 of FIG. 3.
Figure 5:
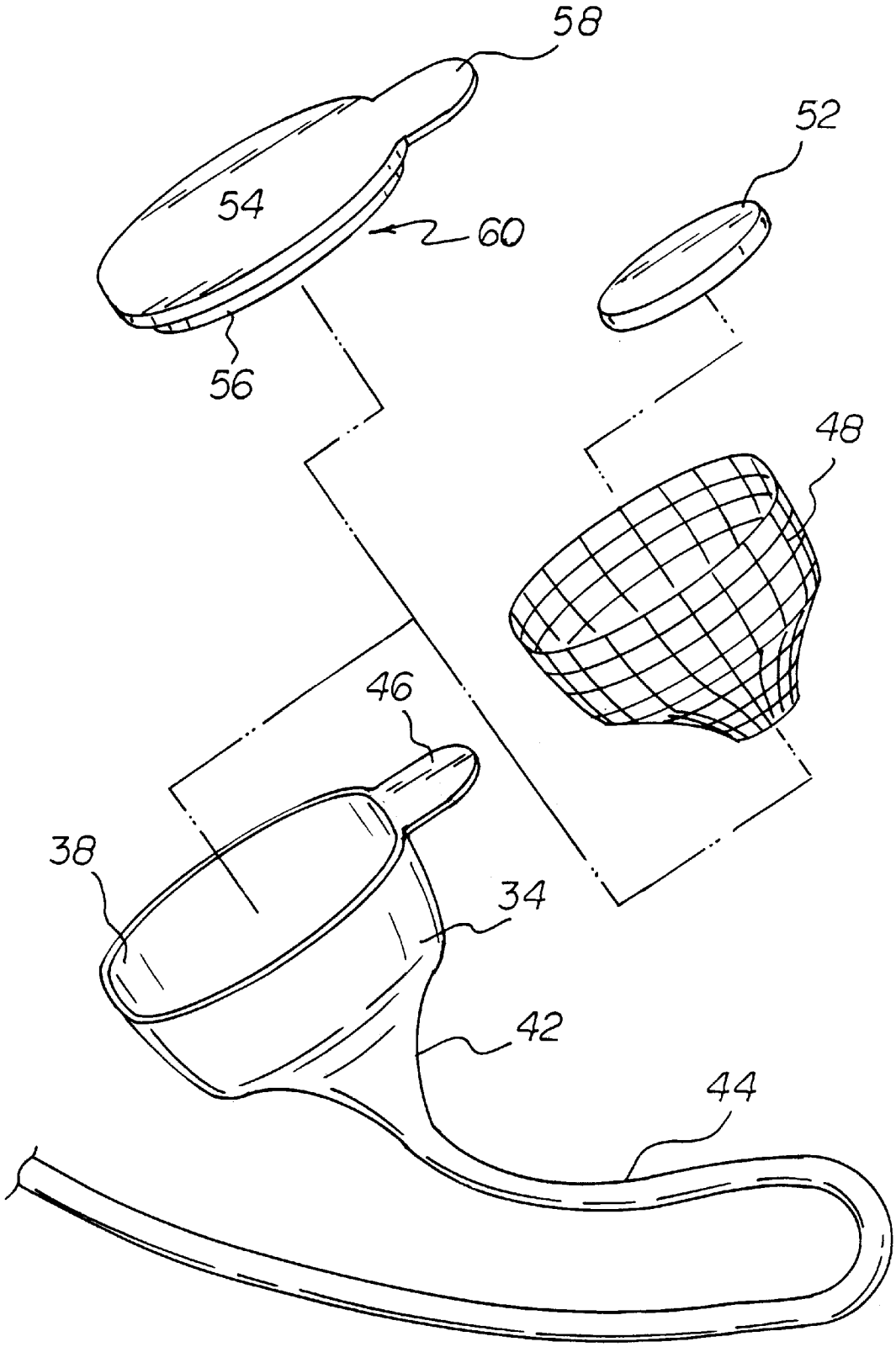
FIG. 5 is an exploded view of the urinal aid of the present invention.

With reference now to FIGS. 3 and 4, the mesh screen 48 employed in the device 32 is illustrated. This screen 48 is positioned within the funnel 34 and functions in preventing foreign objects from entering the hose 44. The screen 48 also permits a urinal cake 52 to be positioned within the funnel 34. The cake 52 emits a pleasant fragrance and covers any otherwise unpleasant smells. FIG. 5 illustrates the relationship between the screen 48 and the urinal cake 52.

FIG. 5 also illustrates the lid 54 that is employed over the finnel portion 34 of the device 32. This lid 54 design include an integral lip 56 formed about its periphery. This lip 56 creates a shallow cup 60 adapted to hold a small volume of fluid when the lid 54 is inverted. Furthermore, the lip 56 is dimensioned to form a friction fit with the opening 38 of the funnel 34. Thus, the lid 54 can be positioned over the opening 38 of the funnel 34. In this orientation, the friction fit of the lip 56 forms a positive fit between the lid 54 and funnel 34, thereby avoiding unintentional lid 54 removal. Thereafter, the lid 54 can be removed with the aid of a handle 58. Once removed, the lid can be turned over and used as a cup 60. This is desirable when an insufficient amount of urine is present. When this occurs, drainage over the trap 26 is precluded and urine pools in the funnel and hose (34 and 44, respectively). This situation is avoided by supplying a small amount of water to the funnel 34 by way of the cup 60. Thus, when removed from the funnel 34 the cup 60 can be filled with water and the water can thereafter be poured into the funnel 34 for the purpose of flushing urine over the trap 26.

The final component of the system 10 is the stand 62. The stand 62 provides a convenient storage area for the device 32 when it is not in use. The stand is defined by a lower bulbous portion 64 for receipt of the hose 44, and an upper cone shaped opening 66 for receipt of the funnel 34. These two portions are interconnected by a narrow intermediate extent 68. The support thus retains the aid in an upright orientation.

The operation of the present invention is next described. The funnel and hose are typically stored in an upright manner by way of the stand. Thus, a user first removes the device from the stand. Thereafter, the hose is inserted within a toilet such that the distal end of the hose is directed over the toilet trap. Next, the lid is removed with the assistance of the lid handle. The user can then proceed to urinate. This can either be achieved in a standing orientation, in the case of a man, or a squatting orientation, in the case of a woman. Typically, a sufficient amount of urine is produced to cause all the urine to travel over the trap and be disposed into the sewer line. Otherwise, a the lid is inverted and employed as a cup to gather a small amount of water. This water is then used to flush any collected urine. The lid can then be positioned upon the funnel. The device can then be replaced into the stand. Sanitary conditions are promoted because the entire device is covered by a water repellant material.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A water conserving urination device for use in conjunction with a toilet having a bowl and a trap in communication with a sewer line, the device comprising:

a funnel portion and a hose portion, the funnel portion having an opened upper end and a tapering lower end that is integral and in fluid communication with the hose, the funnel portion adapted to receive urine from a user, the hose being positioned within the bowl with a distal end of the hose being disposed over the trap and in direct fluid communication with the sewer line, the funnel and hose being portable;

a lid having an integral lip formed about a periphery, the lip creating a cup adapted to hold a volume of fluid, the lip being dimensioned to form a friction fit with the opening of the funnel, when removed from the funnel the cup can be filled with water and the water can thereafter be poured into the funnel for the purpose of flushing urine over the trap.

2. The device as described in claim 1 wherein the entire device is covered with hydrophobic material.

3. The device as described in claim 1 further comprising:

a mesh screen positioned within the funnel and functioning to prevent foreign objects from entering the hose.

4. The device as described in claim 1 further comprising:

a stand for use in supporting the funnel and hose when not in use.

5. A water conserving urination system comprising:

a toilet having a bowl containing a volume of fluid adapted to be periodically disposed by way of flushing, a trap at a lower end of the bowl in communication with a sewer line;

a urinary aid having a funnel portion and a hose portion, the funnel portion having an interior portion and a squared cross section, an opened upper end and a tapering lower end that is integral and in fluid communication with the hose, the funnel portion adapted to receive urine from a user, a handle integral with the upper end of the funnel for assisting a user in grasping the aid, the hose being positioned within the bowl with a distal end of the hose being disposed over the trap and in direct fluid communication with the sewer line, the entire aid being covered with hydrophobic material;

a mesh screen positioned within the funnel and functioning to prevent foreign objects from entering the hose;

a lid having an integral lip formed about a periphery, the lip creating a cup adapted to hold a volume of fluid, the lip being dimensioned to form a friction fit with the opening of the funnel, the lid further including a handle to assist in removing the lid from the funnel, when removed from the funnel the cup can be filled with water and the water can thereafter be poured into the funnel for the purpose of flushing urine over the trap;

a stand for use in supporting the aid when it is not in use, the stand having a lower bulbous port for receipt of the hose, and upper cone shaped opening for receipt of the funnel and a narrow intermediate extent.

* * * * *